United States Patent [19]

Gunton

[11] 4,178,568

[45] Dec. 11, 1979

[54] STRIPLINE COUPLER HAVING COMB ELECTRODE IN COUPLING REGION

[75] Inventor: David J. Gunton, West Malvern, England

[73] Assignee: The Secretary of State for Defence in Her Britannic Majesty's Government of the United Kingdom of Great Britain and Northern Ireland, London, England

[21] Appl. No.: 890,767

[22] Filed: Mar. 27, 1978

[30] Foreign Application Priority Data

Apr. 1, 1977 [GB] United Kingdom ..... 13926/77

[51] Int. Cl.[2] ..... H01P 5/18

[52] U.S. Cl. ..... 333/116; 333/238

[58] Field of Search ..... 333/10, 30 R, 72; 310/313, 366

[56] References Cited

U.S. PATENT DOCUMENTS

| | | | |
|---|---|---|---|
| 3,629,733 | 12/1971 | Podell | 333/10 |
| 4,027,254 | 5/1977 | Gunton et al. | 333/10 |

*Primary Examiner*—Paul L. Gensler

*Attorney, Agent, or Firm*—Pollock, Vande Sande and Priddy

[57] ABSTRACT

A microstrip or stripline coupling device in which coupling is effected between two spaced transmission line electrodes at least one of which is a comb electrode comprising a bus bar having a series of electrode fingers projecting transversely from both sides thereof along the coupled length. Preferably both electrodes are comb electrodes, the fingers of which are interdigitated to improve the coupling. In a broadband coupler in accordance with the invention, the difference between the phase constants of the two electrodes is varied along the coupled length, e.g. by varying the lengths of the fingers, enabling the concept of warped mode coupling to be realized. Preferably also the coupling coefficient between the two electrodes is varied along the coupled length, e.g. by varying the spacing between the electrodes or the degree of overlap between the electrode fingers.

14 Claims, 4 Drawing Figures

OUT
IN
M

STRIPLINE COUPLER HAVING COMB ELECTRODE IN COUPLING REGION

This invention relates to coupling devices formed in microstrip or stripline and is a modification of or improvement in the invention of U.S. Pat. No. 6,027,256.

The above-mentioned patent discloses a coupling device comprising a dielectric substrate having two opposing faces, a ground sheet electrode on one face and two spaced comb electrodes on the other face, each comprising a bus bar formed along one side with a series of electrode fingers projecting towards the other electrode, and arranged so that a portion of a signal applied to one of the electrodes is transferred to the other.

For a coupling device of the above kind which is uniform along its coupled length, the maximum transfer of power achievable between the two electrodes is related to the difference in the phase constants of the two electrodes; and the most convenient way of effecting this difference is to provide the two electrode structures with electrode fingers of different length. However, if performance is not to suffer, the maximum permissible length for the electrode fingers of either electrode is determined by the upper limit of the desired operating frequency range, and this in turn places a restriction on the maximum difference which can be achieved in the phase constants of the two electrodes for a given finger width and spacing interval.

According to the present invention, in a coupling device comprising a dielectric substrate having two opposing faces, a ground sheet electrode on one face of the substrate and two elongate spaced electrodes on the other face of the substrate coupled to one another along at least a part of their respective lengths so that a portion of a signal applied along one of the electrodes is transferred to the other, at least one of the electrodes is a comb electrode comprising a main conductor or bus bar formed along its coupled length with a series of electrode fingers projecting transversely from both sides thereof.

The other electrode may be a plain, unprofiled strip electrode, (i.e. without any electrode fingers) although preferably it is a comb electrode comprising a main conductor or bus bar formed along its coupled length with a series of electrode fingers projecting from one or both sides thereof.

Where both electrodes are comb electrodes, each preferably has electrode fingers projecting into the spaces between electrode fingers of the other electrode.

In a simple form of coupling device in accordance with the invention the phase constant of each electrode, and the degree of coupling between the electrodes, are substantially constant throughout the region along which the two electrodes are coupled. Such properties can be achieved by using comb electrodes in which the dimension and spacing of the electrode fingers of each series are uniform and arranging the electrodes parallel to one another along their coupled length.

Such an arrangement produces a periodic transfer of power along the coupled length and where the phase constants of both electrodes are equal, complete power transfer between the two electrodes can be achieved. For non-equal phase constants the maximum power transferred between the electrodes is related to the difference in the phase constants of the two electrodes which can conveniently be varied by adjustment of the lengths of the electrode fingers, and in this respect the novel concept of placing electrode fingers on both sides of the comb electrode provides greater flexibility in design.

A characteristic of this simple type of coupling device is their frequency dependence, in that the proportion of the input power coupled from one electrode to the other in a given coupled length varies with frequency or, conversely, the coupled length required to couple a given proportion of the input power from one electrode to the other varies with frequency and limits the bandwidth of the device. In the case of directional couplers, this can be a disadvantage.

Thus in an alternative form of coupling device in accordance with the invention, the difference between the phase constants of the two electrodes varies gradually along their coupled length. In this way, the concept of warped mode coupling as set forth in separate articles by J. S. Cook, A. G. Fox and W. H. Louisell in Bell Systems Technical J., Vol. 34, pages 807 to 870, (1955), can be realized in microstrip or stripline form.

By gradually varying the difference in the phase constants along the coupled length, the energy introduced to the device in the form of a local normal mode appropriate to the point of entry (e.g. a signal along one of the electrodes) will propagate throughout the structure substantially maintaining its distribution between the coupled waves in a local normal mode, i.e. the field patterns at any cross section will be the same as the normal mode patterns for a uniform coupler having the same cross sectional properties.

Preferably the strength of coupling between the two electrodes also varies along the coupled length.

In a preferred form of warped mode coupling device in accordance with the invention, the difference between the phase constants of the two electrodes (either when they are coupled or when they are uncoupled) varies cosinusoidally, and the strength of coupling or coupling coefficient between the two electrodes varies sinusoidally with distance from one end of their coupled length.

The variations in the phase constants of a comb electrode can be effected by varying the dimensions and periodic spacing of the electrode fingers, while the coupling coefficient depends on the separation between the electrodes of the coupler, and in the case of interdigital comb electrodes, the extent of overlap of and the proximity of the interdigitated fingers. Again the provision of electrode fingers on both sides of the main conductor of a comb electrode enables a greater degree of variation with length of the phase constant of the electrode.

The invention will now be described, by way of example only, with reference to the accompanying drawings of which:

Figure 1:
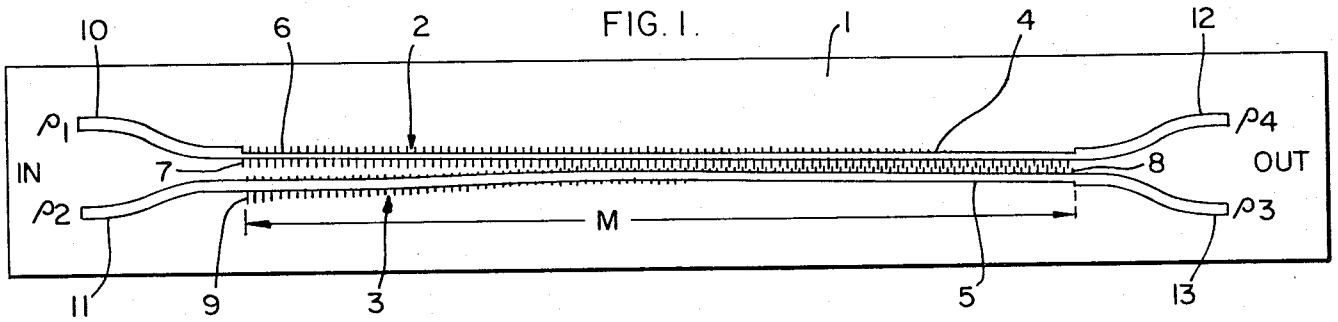
FIG. 1 is a diagrammatic view of one form of directional coupler in accordance with the invention.

The directional coupler shown in FIG. 1 comprises a flat substrate 1 of polyolefin material, e.g. Polyguide (Trade Mark), alumina or other dielectric material covered on its lower surface with a ground or earth sheet copper electrode (not shown) and carrying on its upper face two planar copper elongated comb electrode structures 2,3 each comprising a main conductor or bus bar, 4,5 with a series of electrode fingers 6,7,8,9 projecting normal thereto from both sides to produce a herringbone structure. All electrode fingers 6,7,8,9 are equispaced, and some of the inwardly directed fingers 7,8 of the two electrode structures are interdigitated. Copper lead strips 10,11,12,13 connect the combs to ports P1,P2,P3,P4 respectively so that an input signal may be applied between strips 10 and the ground plane at port P1, etc.

As can be clearly seen, the electrode structures 2,3 are non-uniform along the length M of their coupled region. This is evidenced by the non-parallel disposition of the two electrode structures, the variation in the lengths of the electrode fingers 6,7,8,9 along the length M of the coupled region, and the extent of overlap t (see FIG. 2) of the interdigitated electrode fingers 7,8 which varies from a positive value at the right hand end of the devive as shown, to a negative value at the left, where there is an increasing gap between the ends of the fingers. Furthermore, the general symmetry, or asymmetry, between the electrode structures varies between complete symmetry at the right hand end becoming increasingly asymmetrical towards the left hand end of the coupled region.

The design of a directional coupler of the above type, operating on the principle of warped modes as set forth in the above mentioned articles by J. S. Cook, A. G. Fox and W. H. Louisell will now be considered with reference to FIGS. 2 and 3.

Warped mode couplers are characterized by a slow spatial variation in the asymmetry of the coupled transmission lines, in the present invention the two electrode structures 2,3, so that the structure of the local normal modes gradually changes, or is 'warped', along the length M of the coupled region. (A local normal mode at a particular cross-section of the coupler has substantially the same form as a conventional normal mode of a structure whose coupling properties along its entire length are the same as those at the cross-section under consideration.) Couplers of this type have been considered in the above-mentioned articles and it was shown that very broadband operation was possible at any desired coupling level provided that the warping of the modes took place over several wavelengths: the greater the length the broader was the bandwidth.

It is a characteristic of all warped mode couplers that energy introduced to the coupling system in the form of a local normal mode appropriate to the point of entry will propagate throughout the system maintaining its distribution between the coupled waves in a local normal mode, even though that distribution may vary spatially. Consequently the aim in designing a warped mode coupler is to arrange that the input condition (usually a signal applied to one or other of the input ports P1,P2) forms one of the local normal modes at the start of the coupled region L; the asymmetry of the structure is then gradually warped until the energy distribution between the electrodes in the local normal mode at the output end of the coupled region corresponds to that required. The frequency dependence is minimal. Further, the phase difference between the output signals at P3 and P4 also remains substantially constant at 0 or 180° depending on which port P1,P2 was used as input, that is, which normal mode was originally excited. Planar transmission lines in the form of electrodes may have a frequency range of operation extending from DC to beyond 20 GHz, so that this property, together with the fact that, like waveguides, when coupled they may be made to operate codirectionally, makes them an ideal way of realizing couplers with the very broad bandwith inherent in the method of warped modes.

From the articles by Fox and Louisell mentioned above, it will be seen that propagation on the two comb electrodes can be made equivalent to that on an analog twisted birefringent waveguide if the phase constants $\beta_I^c$ and $\beta_{II}^c$ of the coupled waves propagating on each comb electrode 2,3 respectively, and the mutual and self-coupling coefficient k between the electrodes vary with $\rho$ (the parameter corresponding to the twist angle o in the birefringent analogue ($\rho \equiv 2\sigma$) in the following way:

$$\beta_I^c = \tfrac{1}{2}(\beta_{IO}^c + \beta_{IIO}^c) + \tfrac{1}{2}(\beta_{IO}^c - \beta_{IIO}^c)\cos\rho \quad (1)$$

$$\beta_{II}^c = \tfrac{1}{2}(\beta_{IO}^c = \beta_{IIO}^c) - \tfrac{1}{2}(\beta_{IO}^c - \beta_{IIO}^c)\cos\rho \quad (2)$$

$$k = \tfrac{1}{2}(\beta_{IO}^c - \beta_{IIO}^c)\sin\rho \quad (3)$$

where $\beta_{IO}^c$ and $\beta_{IIO}^c$ refer to the coupled phase constants at the position $\rho = 0$. Here the coupled equations describing the system are taken to be:

$$dV_I/dz = -j\beta_I^c VI + jkV_{II} \quad (4)$$

$$dV_{II}/dz = -j\beta_{II}^c V_{II} + jkV_I \quad (5)$$

in which z is distance along the coupled region and $V_I$ and $V_{11}$ are the complex voltage amplitudes on electrodes 2 and 3; the mutual coupling coefficient k is taken to be equal to the self-coupling coefficient, so that the uncoupled phase constants $\beta_I^u$ and $\beta_{II}^u$ are related to the coupled phase constants by $$\beta_I^c = \beta_I^u + k;\ \beta_{II}^c = \beta_{II}^u + k. \quad (6)$$

At this stage the relation between the twist angle $\sigma$ and the position z along the coupled region need not be specified, though it is noted that a uniform "twist" is implied by a linear relationship.

(i) The beat wavelength $\lambda_b$, defined as the length required for a complete cycle in the periodic power transfer variation in a uniform coupler, is given by $$\lambda_b = \pi/\sqrt{x^2 + k^2}, \quad (7)$$

where $$x = \tfrac{1}{2}(\beta_I^u - \beta_{II}^u) = \tfrac{1}{2}(\beta_I^c - \beta_{II}^c).$$

(ii) The normal mode phase constants $\beta_1^N$ and $\beta_2^N$ are given by $$\beta_1^N = \tfrac{1}{2}(\beta_I^c + \beta_{II}^c) + \sqrt{x^2 + k^2} \quad (8)$$

$$\beta_2^N = \tfrac{1}{2}(\beta_I^c + \beta_{II}^c) - \sqrt{x^2 + k^2}. \quad (9)$$

When $\beta_I^c$, $\beta_{II}^c$ and k are given by (1) and (2) it follows from (8) and (9) that $\beta_1^N = \beta_{IO}^c = \beta_{IO}^u$; $\beta_2^N = \beta_{IIO}^c = -\beta_{IIO}^u$ and each is independent of $\rho$. This is consistent with the birefringent waveguide analogue for which the normal mode velocities do not depend on position. For this case also the structure of the normal modes, $V_{II}/V_I = m_1$ or $= 1/m_1$, is given by $m_1 = \tan\sigma$.

Figure 3A:
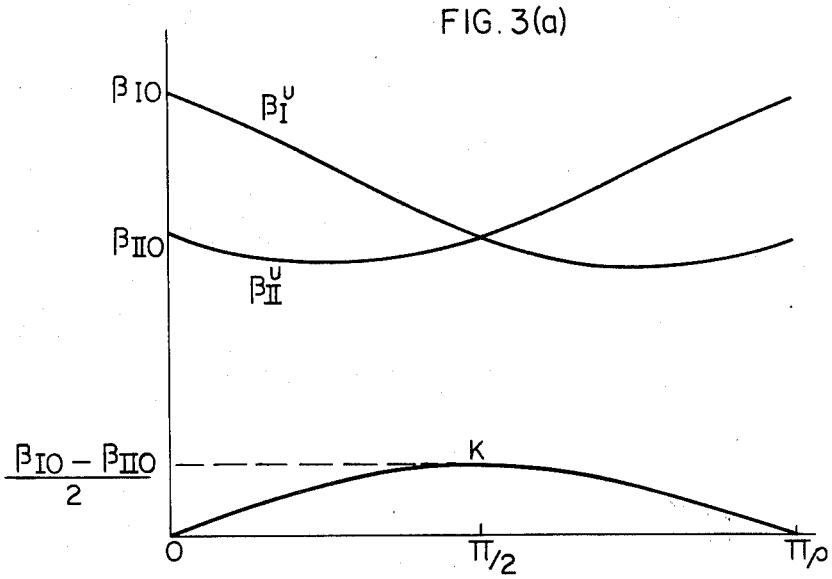
FIGS. 3(*a*) and 3(*b*) are graphs showing the variation of coupling coefficient and two possible forms of variation of the phase constants of the two electrodes before coupling. The abscissa, $\rho$, is related to a length co-ordinate, Z as will be explained.
Figure 3B:
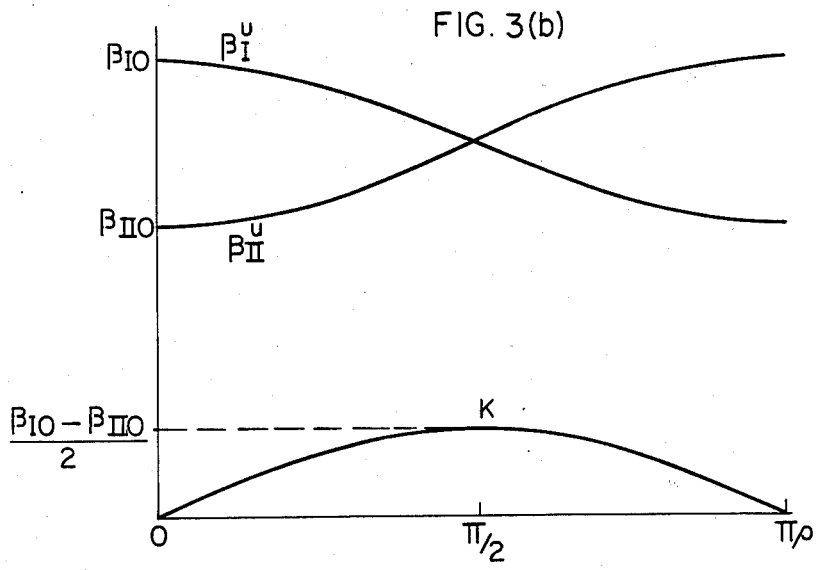

In order to simplify the construction of a practical warped mode directional coupler it is useful to know the required spatial variation of the uncoupled phase constants since that enables the two electrodes 2,3 which are subsequently to be coupled to be designed independently. From (1) to (3) and (6) it follows that the variation with $\rho$of $\beta_I^u$ and $\beta_{II}^u$ is given by $$\beta_I^u = \tfrac{1}{2}(\beta_{IO}+\beta_{IIO}) + \tfrac{1}{2}(\beta_{IO}-\beta_{IIO})\,(\cos\rho - \sin\rho) \quad (10)$$

$$\beta_{II}^u = \tfrac{1}{2}(\beta_{IO}=\beta_{IIO}) - \tfrac{1}{2}(\beta_{IO}-\beta_{IIO})\,(\cos\rho + \sin\rho) \quad (11)$$

in which the superscripts have been dropped from the $\rho=0$ phase constants since they are redundant. This variation is shown in FIG. 3(*a*). From (1) and (2) and from (10) and (11) we see that $$(\beta_I^c - \beta_{II}^c) = (\beta_I^u - \beta_{II}^u) = (\beta_{IO} - \beta_{IIO}) \cos \rho. \quad (12)$$

It was shown in the article by Louisell that a more fundamental requirement than that expressed by (1) and (2) is that the difference in phase constants, 2x varies cosinusoidally with $\rho$, as in (12); this requirement also means that the difference $(\beta_1^N = \beta_2^N)$ is constant, together with the local beat wavelength$\lambda_b$, while the variation of $m_1$ remains as given above. A device with these properties is referred to as a constant local beat wavelength coupler. However, once the condition of $\rho$-independence of the two normal mode velocities and of the mean coupled phase constant is relaxed, it may be advantageous to consider these related quantities as able to vary. This situation would be represented by, in the analogy, a birefringent medium in which the normal mode velocities change with position. One such variation is that in which the mean uncoupled phase constant remains unchanged and $\beta_I^u$ and $\beta_{II}^u$ have a variation similar to that of $\beta_I^c$ and $\beta_{II}^c$ in (1) and (2); this is shown in FIG. 3(*b*) and implies a reduction in the normal mode velocities in regions of higher coupling coefficient. The apparent advantage of the larger electrical length in such regions, with its attendant implications for ripple and bandwith, is exactly offset by the reduced difference in mode velocities: it is the beat wavelength$\lambda$b which is critical and that remains unchanged. For practical purposes, however, the advantage in a variation of the form of FIG. 3(*b*) lies in a different direction. The smallest value of $\beta^u$ possible in practice is for a transmission line electrode with no fingers attached, while the largest value is set by the maximum finger length consistent with the upper limit to the frequency range of operation. This upper limit is set approximately at the frequency at which the longest fingers are quarter wave resonant. A variation of the form of FIG. 3(*b*) therefore enables a larger maximum coupling coefficient ($k_{max}$) to be used and thus a smaller beat wavelength than that of FIG. 3(*a*) since the maximum coupling is related to the difference in phae constants at the zero coupling end of the device. But if the same value of $k_{max}$ is used then each scheme gives identical results.

Figure 2:
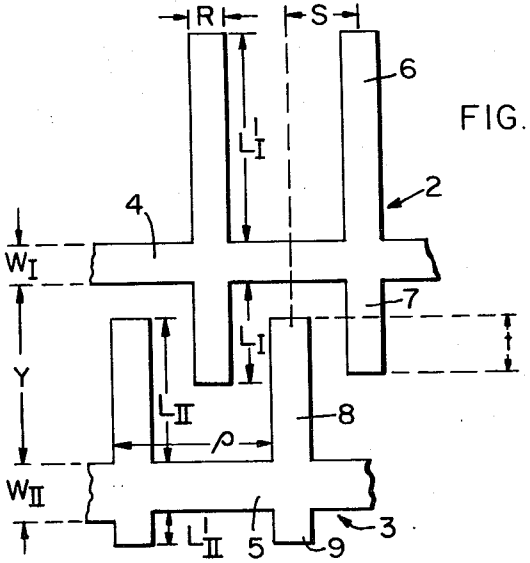
FIG. 2 shows on an enlarged scale, a section of the electrode assembly of the coupler shown in FIG. 1.

In designing a practical warped mode directional coupler of the kind shown in FIG. 1, the following parameters are identified in FIG. 2 may be varied in order to achieve the desired variation in the phase constants and coupling coefficients between the two electrodes 2,3:

(a) Variation in the separation Y of the two bus bars 2,3 (by making them non-parallel) and/or variation in the separation S and extent of overlap t of the inwardly projecting electrode fingers 7,8 to achieve a variation in the coupling coefficient. In this connection it will be noted that interdigitation of the fingers 7,8 represents a positive overlap t, while a separation between the ends of the fingers 7,8 in a direction transverse to the bus bars 4,5 represents a negative overlap.

(b) The propagation velocity and hence the phase constant of an isolated uncoupled electrode 2,3 is determined by the degree of loading provided by the electrode fingers 6,7,8,9. This may be varied by varying the dimensions (lengths $L_I$, $L_I'$; $L_{II}$, $L_{II}'$and widths (R) and period or spacing P between the fingers of each comb electrode structure. In this connection the provision of fingers 6,9 on both edges of the bus bars 4,5 enables a greater range of variation in the phase constants to be achieved.

(c) Variation in the widths $W_I$; $W_{II}$ of the two bus bars 4,5 enables the characteristic impedance of the electrodes 2,3 to be adjusted without significantly affecting their other properties as set by the finger dimensions and spacings. This feature enables the characteristic impedance of each electrode 2,3 to be made substantially constant along its length.

In designing a practical warped mode coupler, therefore, it is necessary to determine a set of dimensions in the form $L_I(\rho)$, $L_I'(\rho)$, $L_{II}(\rho)$, $L_{II}'(\rho)$, $W_I(\rho)$, $W_{II}(\rho)$, $Y(\rho)$ which specify the finger lengths, bus bar widths and bus bar separation effectively as a function of position in the coupled region.

Some initial experimental characterization of the electrodes is required which will now be described, for which the period, the overlapping finger separation and the finger width are held constant throughout. Values of these quantities are affected by the need to relate $k_{max}$ to the maximum difference in phase constants. The calibrations performed are as follows:

(i) Determination of the overlap dependence of k

For a series of overlaps the first coupling frequency $f_c$ (the frequency at which the coupled power reaches the first maximum) is determined for a spatially uniform directional coupler of a fixed length. This leads to the beat wavelength$\lambda$b and equation (7) then gives a value for k. The phase constant difference (2x) can be taken as zero in this determination even when the coupled comb electrodes are nonidentical since the error introduced in k is only a few percent. The coupling coefficient is a monotonic function of overlap provided that the end gap between the fingers of one electrode and the bus bar of the other is greater than the finger spacing (t).

(ii) Determination of the dependence of $\beta^u$ on L and L'

The 'herringbone' design enables a sufficiently large value of the maximum phase constant difference, and hence of $k_{max}$ to be achieved. A set of curves giving the variation of $\beta^u$ with L and L' is produced corresponding to several combinations of the finger lengths, and which are suitable for interpolation. Several curves are required since $\beta^u$ is not a monotonic function of (L + L').

(III) Characteristic impedance

The characteristic impedance of a single 'herringbone' comb electrode of fixed width $W_I$, $W_{II}$ may be determined by time domain reflectometry, and is a function of (L + L') only; in order to obtain a 50Ωline for a given value of (L + L') the width W can be varied. However, the characteristic impedance of one line when coupled to another is perturbed by the coupling and an approximate measure of the correction to be made to Z, the characteristic impedance for a given value of k may be obtained from impedance measurements made during stage (i). The correction to be made to the original width, eg $W_I$, so as to obtain a characteristic impedance of 50Ωfor given values L,L' and k is found by using the value of $dW_I/dZ$ applicable to a conventional strip transmission line (L + L' =0) on the same dielectric substrate.

Either of the two variations of $\beta_I^u$ and $\beta_{II}$ with $\rho$ shown in FIGS. 3(*a*) and 3(*b*) may be used as the basis on which to determine the physical dimensions of the coupled comb electrodes. For either case a universal design can be obtained in the sense that by truncating it at the correct value of $\rho$ any coupling level may be obtained. The distribution of energy between the coupled lines varies as $\sin^2\rho/2$ when the input is applied to one port, say P1, at the asymmetrical end of the device ($\rho$=O), so that a 3dB coupler, for example, is obtained when the maximum value of $\rho$ is $\pi/2$ (as in the FIG. 1 embodiment); $\rho=\pi$ gives OdB coupling.

The variation of $\rho$ with distance z along the coupled region may be linear, although a reduction in the normal mode cross-talk which inevitably arises when the warping does not take place infinitely slowly can be achieved by making this variation non-linear. For example, $\rho$ may be made to vary as $\sin^2(z\pi)/(2M)$ thus bringing the "twist" rate to zero at each end of the coupled region and reducing the above-mentioned cross-talk.

In other design procedures it may be found desirable to vary the periodic spacing and/or widths of the finger electrodes 6,7,8,9 of each comb electrode 2,3 along the length of the coupled region. It will be appreciated that it may not always be necessary to provide finger electrodes on both sides of the bars 4,5 of both electrodes 2,3. The necessary variation in phase constants may in such cases be achieved by providing outer finger electrodes on only one of the comb electrodes, and in some cases it may be possible to design an arrangement in which one of the electrodes of the coupler has no finger electrodes at all. Although only very small variations in the coupling coefficient could be achieved, such an arrangement may prove useful where it is required to couple energy into an existing system incorporating a straight-sided strip electrode adjacent to which a suitably dimensioned herringbone comb electrode could be deposited.

Where required, the electrodes may be bent or curved to produce a more compact arrangement, or the coupler may be divided into two or more longitudinal sections, laid side-by-side for example, and the sections of each electrode connected together in series using suitable transmission line connections.

In a further variation the electrode assembly of FIG. 1 may be covered with another sheet of dielectric material, itself backed with a ground sheet electrode. This arrangement is useful for reducing radiation losses, especially with low dielectric constant materials and constitutes a triplate configuration.

Although the inveniton has been described in its application to directional couplers operating on the principle of warped normal modes, it may nevertheless be applied with advantage in directional couplers which do not operate on the warped mode principle. Furthermore, directional couplers and coupling devices in accordance with the invention may be used in most applications in which known forms of transmission line coupler are used, for example in phase shifters, dispersive delay lines and mixers.

What I claim is:

1. A coupling device comprising a dielectric substrate having two opposing faces, a ground sheet electrode on one face of the substrate and two elongate spaced electrodes on the other face of the substrate coupled to one another along at least a part of their respective lengths so that a portion of the power of a signal applied along one of the electrodes is transferred to the other, wherein at least one of the electrodes is a comb electrode comprising a main conductor or bus bar formed along its coupled length with a series of spaced electrode fingers projecting transversely from both sides thereof.

2. A coupling device as claimed in claim 1, wherein the other electrode is also a comb electrode comprising a main conductor or bus bar formed along its coupled length with a series of electrode fingers projecting transversely from one or both sides thereof.

3. A coupling device as claimed in claim 1, wherein the difference between the phase constants of the two electrodes varies along their coupled length.

4. A coupling device as claimed in claim 3, wherein the strength of coupling between the two electrodes varies along their coupled length.

5. A coupling device as claimed in claim 1, wherein the difference between the phase constants of the two electrodes varies cosinusoidally with distance along their coupled length.

6. A coupling device as claimed in claim 5, wherein the strength of coupling between the two electrodes varies sinusoidally with distance along their coupled length.

7. A coupling device as claimed in any one of claims 1 to 6, wherein the lengths of the electrode fingers of at least one series vary along the coupled length.

8. A coupling device as claimed in any one of claims 1 to 6, wherein the widths of the electrode fingers of at least one series vary along the coupled length.

9. A coupling device as claimed in any one of claims 1 to 6, wherein the spacing intervals between the electrode fingers of at least one series vary along the coupled length.

10. A coupling device as claimed in any one of claims 1 to 6, wherein the separation between the bus bars of the two electrodes varies along the coupled length.

11. A coupling device as claimed in any one of claims 3 to 6, wherein the width of the bus bar of one or both electrodes varies so as to maintain the characteristic impedance of each electrode substantially constant along its coupled length.

12. A coupling device as claimed in any one of claims 2 to 6, wherein each electrode has fingers which project into the spaces between electrode fingers on the other electrode.

13. A coupling device as claimed in claim 12, wherein the extent of overlap, or the transverse distance between the free ends of confronting series of electrode fingers varies along the coupled length.

14. A coupling device as claimed in any one of claims 1 to 6, and comprising a further substrate having two opposing faces, one carrying a further ground sheet electrode and the other lying in contact with the two electrodes.

* * * * *